United States Patent [19]

Plantif et al.

[11] 3,964,256

[45] June 22, 1976

[54] PRODUCTION OF NON-TOXIC GAS BY COMBUSTION OF SOLID PROPELLANT

[75] Inventors: Bernard E. Plantif; Bernard J. Doin; Jean S. Beaumont, all of Saint-Medard-en-Jalles, France

[73] Assignee: Societe Nationale des Poudres et Explosifs

[22] Filed: Oct. 10, 1973

[21] Appl. No.: 405,062

[30] Foreign Application Priority Data

Oct. 17, 1972 France ..... 72.36739

[52] U.S. Cl. ..... 60/219; 149/83; 280/728

[51] Int. Cl.[2] ..... C06D 5/00

[58] Field of Search ..... 60/219, 220; 149/19.2, 149/19.6, 5, 2, 3, 83; 9/321; 23/281; 280/150 AB; 102/39

[56] References Cited

UNITED STATES PATENTS

| | | | |
|---|---|---|---|
| 2,566,560 | 9/1951 | Edelberg | 149/83 |
| 2,946,671 | 7/1960 | Marti | 149/19.6 |
| 3,171,764 | 3/1965 | Parker et al. | 149/83 |
| 3,197,349 | 7/1965 | Kuhn et al. | 149/19.2 |
| 3,214,308 | 10/1965 | Rice | 149/83 |
| 3,222,230 | 12/1965 | Hebenstreit et al. | 9/321 |
| 3,453,156 | 7/1969 | Hackett et al. | 149/19.2 |
| 3,738,878 | 6/1973 | Green | 149/83 |
| 3,797,854 | 3/1974 | Poole et al. | 60/219 |

*Primary Examiner*—Samuel Feinberg
*Attorney, Agent, or Firm*—Bucknam and Archer

[57] ABSTRACT

A process for the rapid production of a substantial volume of non-toxic gas at a moderate temperature, comprises:

a. effecting combustion of a pyrotechnic charge consisting of a composite solid propellant having a high content of inorganic oxidant, in excess of 80 percent and a low content of a carbonaceous, non-nitrogenous binder, not in excess of 17 percent in a combustion chamber to produce a substantial volume of combustion gases at an elevated temperature b. a first cooling phase in which the hot combustion gases are diluted with oxygen obtained by the thermal decomposition of an oxygen-containing inorganic compound which has a low thermal stability and liberates, in gaseous form, only oxygen, whereby the combustion gases are cooled to a temperature of from 225° to 700°C, and c. a second cooling phase in which the gas mixture from the first cooling phase is cooled by contact with cooling means to the temperature of utilization.

The gas mixture so produced is used, for example, for the inflation of flexible enclosures and for the deployment of inflatable safety devices, such as in automobiles.

11 Claims, No Drawings

PRODUCTION OF NON-TOXIC GAS BY COMBUSTION OF SOLID PROPELLANT

This invention is concerned with a process for the production of large volumes of non-toxic gases having a relatively low temperature by the combustion of a solid propellant, such gases being, in particular, used for the inflation of flexible envelopes and for the deployment of inflatable safety devices provided in vehicles, such as motor cars.

The gas cooling processes carried out in conjunction with presently known pyrotechnic generators employ liquid or solid coolants which change in physical state, which decompose chemically, or which undergo a physicochemical transformation resulting from these two effects. Certain of these cooling processes are based on the generation of a considerable gaseous volume to produce a reduction of temperature of the combustion gases obtained from the solid propellant, by dilution and contribute to a considerable improvement in the overall yield of gas from the pyrotechnic generator. However, such cooling processes cannot be used when the gases obtained are to be non-toxic, since the coolants normally used for this purpose provide toxic gases or gases which react with the propellant combustion gases at high temperature to form toxic gases.

We have now developed a process which enables a considerable volume of non-toxic gas at a moderate temperature from the gaseous combustion products of a solid propellant.

According to the present invention, such a process comprises a. effecting combustion of a pyrotechnic charge consisting of a composite solid propellant having a high content of inorganic oxidant in excess of 80 percent and a low content of a carbonaceous, non-nitrogenous binder, not in excess of 17 percent, in a combustion chamber to produce a substantial volume of combustion gases at an elevated temperature.

b. a first cooling phase in which the hot combustion gases are diluted with oxygen obtained by the thermal decomposition of an oxygen-containing inorganic compound which has a low thermal stability and liberates, in gaseous form, only oxygen, whereby the combustion gases are cooled to a temperature of from 225° to 700°C, and c. a second cooling phase in which the gas mixture from the first cooling phase is cooled by contact with cooling means to the temperature of utilisation.

The inorganic oxidant present in the propellant is preferably an alkali metal or alkaline earth metal perchlorate and the binder present in the propellant is preferably cellulose triacetate or a silicone resin.

According to a preferred embodiment of the invention, the propellant comprises:

- in excess of 80 percent by weight of potassium perchlorate,
- up to 17 percent by weight of cellulose triacetate or silicone resin binder,
- optionally, a plasticiser selected from triacetin and tricresyl phosphate, and
- optionally, as a modifying agent, up to 0.5 percent of carbon black and/or up to 5 percent of aluminium powder.

The ratio of binder:perchlorate is preferably such as to give less than 500 ppm of CO in the combustion gases.

Particularly preferred propellants are of the following compositions, in parts by weight:

| | | |
|---|---|---|
| potassium perchlorate | in excess of | 80 to 92 |
| cellulose triacetate | | 8.5 to 17 |
| plasticiser selected from triacetin and tricresyl phosphate | | 1 to 3 |
| acetylene black | | 0.15 to 0.5 |
| aluminium powder | | 0.5 to 2 |
| and | | |
| potassium perchlorate | in excess of | 80 to 92 |
| silicone resin having a carbon content of less than 33% | | 8.5 to 14 |
| catalyst for the silicone resin | | 0.8 to 1.5 |
| acetylene black | | 0.15 to 0.5 |
| aluminium powder | | 0.5 to 2 |

The propellant combustion gases are directed in the first cooling phase into an enclosure containing a coolant which decomposes under the action of the heat of the combustion gases and produces oxygen which ensures the cooling of the combustion gases by dilution. This coolant is peferably an alkali metal or alkaline earth metal perchlorate having a decomposition temperature of from 225° to 700°C, the perchlorate being in the form of granules containing a non-oxidisable binder. Such granules are preferably prepared by the agglomeration of the perchlorate, in powdered form, with 1 to 7 percent of the non-oxidisable binder. Trials have been carried out with $MgClO_4$, $LiClO_4$ and $BaClO_4$ whose respective gas yields are 0.45 l/g, 0.42 l/g and 0.20 l/g, the particle size of the granules being chosen in accordance with the rate of decomposition of these perchlorates. The binder may be organic, and satisfactory trials have been carried out using, for example 1% by weight of aluminum stearate and 99 percent by weight of potassium perchlorate having a particle size of 188$\mu$, and 5 percent by weight of aluminium stearate and 95 percent by weight of potassium chlorate having a particle size of 16$\mu$. The binder may also be inorganic and satisfactory results have been obtained using 2 percent by weight of potassium bromide. Plaster and cement can also be used within the limits 2 to 7 percent by weight. The granulation of these coolant compositions is preferably carried out under pressure and the desired mechanical characteristics are obtained by selecting the nature and percentage of the binder and also the particle size of the perchlorate. The utilisation of powdered perchlorate having two particle sizes, such as 8.4$\mu$ (12 parts) and 20$\mu$ (70 parts), or of two particle size fractions, the coarser being, for example, in the range 60–90$\mu$ (70 parts) and the finer being in the range 10–15$\mu$ (12 parts), gives satisfactory results. The particle size of the granules is chosen in accordance with the loss of the coolant which can be accepted and the contact time of the combustion gases with the coolant, given that the smaller the particle size of the coolant granules, the greater will be the loss of coolant, but that as the surface area of coolant is thus increased, the more rapid will be the decomposition of the coolant. To facilitate the decomposition of the potassium perchlorate, its decomposition temperature can be reduced by associating one or more decomposition catalysts with it. Potassium perchlorate alone has a slightly exothermic decomposition yielding 3.6 cal/g, occurring at about 600°C, and providing 0.348 l of oxygen per gram. This temperature is below the temperature range corresponding to the equilibrium $CO \rightleftharpoons CO_2$ and no production of carbon monoxide is possible by reaction of the oxygen produced with carbonaceous compounds contained in the combustion gases. The cooling of these gases is effected solely by dilution and it is thus advantageous to liberate oxygen from the potassium chlorate at as low a temperature as possible. The incorporation in the coolant of 2 to 8 percent of decomposition catalysts such as iron oxide $Fe_2O_3$, copper oxide CuO or manganese dioxide $MnO_2$ enables the decomposition temperature to be reduced by a hundred degrees centrigrade, and the incorporation of copper chromite enables the decomposition of the potassium perchlorate to be effected at about 425°C.

At the outlet from the enclosure in which the first cooling phase is effected, the pre-cooled gaseous mixture constituted by the combustion gases and the oxygen liberated from the coolant is directed into contact with cooling means to effect the second cooling phase. The choice of this cooling means is determined by the conditions of utilisation of the gases and, particularly, by the temperature of utilisation, the yield of the gases and the total volume.

The second cooling phase can be effected, for example, by contact with a solid particulate coolant comprising a compound which decomposes at a temperature below 200°C to produce a gas. Suitable compounds of this kind are, for example, alkali metal and alkaline earth metal oxalates, carbonates, and bicarbonates, these compounds being in pellet form. Liquid coolants can also be used for this purpose. The cooling means may also consist of mechanical elements constituting a heat exchanger, such as a coil or a heat sink constituted by granules of aluminium silicate. The cooling means may equally consist of a gas, particularly air, supplied by a pump which is driven by gases coming from the second cooling phase or by the device which utilises the gases and is placed at the outlet of the generator.

In order that the invention may be more fully understood, the following examples are given by way of illustration only:

EXAMPLE 1 a. Gas production phase

The propellant utilised was a composite powder of the following composition, in parts by weight:

| | | |
|---|---|---|
| Binder: | cellulose triacetate | 10 |
| Oxidant: | potassium perchlorate (average particle size 16$\mu$) | 88 |
| Plasticiser: | triacetin or tricresyl phosphate | 2.5 |
| Charge: | acetylene black | 0.2 |
| | aluminium powder | 1 |

The pyrotechnic charge of propellant consisted of:

| | | |
|---|---|---|
| a bundle of strands, | of length | 30 mm |
| | of diameter | 4.3 mm |
| | in number | 50 strands |
| | of an approximate mass | 36–37 g. |

This charge was placed in a pyrotechnic generator within a combustion chamber of 38 mm diameter, provided with an ignition system at one end (an igniter and some ignition powder).

The combustion characteristics of this pyrotechnic charge were as follows:

| | |
|---|---|
| Ignition period | 3 to 6 ms |
| Duration of combustion (measured to ½ maximal pressure) | 15 to 20 ms |
| Volume of gas released by the propellant | about 9 liters |
| Yield | 0.25 l/g (20°C; 1 bar) |
| Temperature of the combustion gases | 1150°C |
| Composition of the combustion gases | 16% oxygen 84% $CO_2$ and < 0.04% CO. |

b. First cooling phase

The coolant used in the first cooling phase consisted of pellets based on potassium perchlorate, 9.5 mm in diameter and 3 mm thick, with the following composition, in parts by weight:

| | | |
|---|---|---|
| Coolant: | potassium perchlorate (average particle size 188) | 93 |
| Catalyst: | copper chromite | 5 |
| Binder: | KBr | 2 |

72 g of these pellets were placed in a first cooling chamber, of cross-section 14 cm², of the pyrotechnic generator which was connected in series with the combustion chamber.

The gaseous mixture leaving the first cooling phase was at a temperature of about 425°C, and contained less than 0.04 percent of carbon monoxide, 75.7 percent of oxygen, 24.3 percent of $CO_2$. The yield of oxygen in the first cooling phase was greater than 0.15 l/g (20°C, 1 bar) as against a theoretical yield of 0.348 l/g (20°C, 1 bar).

c. Second cooling phase

The coolant used in the second cooling phase consisted of pellets of sodium bicarbonate, 9.5 mm in diameter and 3 mm thick.

60 g of these pellets were placed in a second cooling chamber (of 14 cm² cross-section) which was connected in series with the first cooling chamber.

The gaseous mixture leaving the second chamber was at a temperature of about 170°C.

The yield of $CO_2$ was 0.143 l/g (at 20°C, 1 bar).

Finally, there was obtained at the outlet of the pyrotechnic generator, 45 l of gas at 150°C and 1 bar, with the following compositions:

| | |
|---|---|
| CO | 400 ppm |
| $CO_2$ | 37.4% |
| $O_2$ | 44.2% |
| $H_2O$ | 18.4% |

The solid residues obtained weighed 110 g and contained:

42 percent of $KClO_4$
15 percent of KCl
21 percent of $Na_2CO_3$
22 percent of $NaHCO_3$ and
traces of $K_2O$ (0.01 percent).

EXAMPLE 2 a. Gas production phase

The propellant used was a composite powder having the following composition, in parts by weight:

| | | |
|---|---|---|
| Binder: | Silicone resin (having a carbon content less than 33%) | 13 |

-continued

| | | |
|---|---|---|
| | resin catalyst | 1.3 |
| Oxidant: | Potassium perchlorate (2 particle sizes, 8μ and 20 μ) | 87 |
| Charges: | Acetylene black | 0.3 |
| | Aluminium powder | 2 |

The pyrotechnic charge of propellant had an approximate mass of 36 g.

b. First cooling phase

The coolant utilised consisted of 50 g of pellets having the following composition, in parts by weight:

| | | |
|---|---|---|
| Coolant: | potassium perchlorate (average particle size 18μ) | 92 |
| Catalyst: | $Fe_2O_3$ | 7 |
| Binder: | Aluminium stearate | 3. |

c. Second cooling phase

The coolant used consisted of 70 g of pellets of sodium bicarbonate.

We claim:

1. A process for the rapid production of a substantial volume of non-toxic gas at a moderate temperature, which comprises the steps of:

a. effecting combustion of a pyrotechnic charge consisting of a composite solid propellant having a high content of inorganic non-nitrogenous oxidant in excess of 80 percent said inorganic oxidant being selected from the group consisting of alkali metal and alkaline earth metal perchlorates and a low content of a carbonaceous, oxygen-containing, binder not exceeding 17 percent, said binder being selected from the group consisting of cellulose triacetate and silicone resins, the remaining ingredients being free of nitrogenous compounds; in a combustion chamber to produce a substantial volume of combustion gases at an elevated temperature, b. passing the hot combustion gases through a first cooling phase in which the hot combustion gases are diluted with oxygen obtained by the thermal decomposition of an oxygen-containing inorganic compound which has a low thermal stability and liberates, in gaseous form, only oxygen, whereby the combustion gases are cooled to a temperature of from 225° to 700°C, and c. passing the gaseous mixture from step (b) to a second cooling phase in which the gas mixture from the first cooling phase is cooled by contact with cooling means to the temperature of utilization.

2. A process according to claim 1, wherein said propellant comprises cellulose triacetate as a binder and also comprises a plasticiser selected from the group consisting of triacetin and tricresyl phosphate.

3. A process according to claim 2, wherein said propellant also comprises, as a modifying agent, at least one of carbon black in an amount of up to 0.5 percent by weight and aluminum powder in an amount of up to 5 percent by weight.

4. A process according to claim 1, wherein said propellant has the following composition, in parts by weight:

| | | |
|---|---|---|
| potassium perchlorate | in excess of | 80 to 92 |
| cellulose triacetate | | 8.5 to 17 |
| plasticiser selected from the group consisting of triacetin and tricresyl phosphate | | 1 to 3 |
| acetylene black | | 0.15 to 0.5 |
| aluminium powder | | 0.5 to 2. |

5. A process according to claim 1, wherein said propellant has the following composition in parts by weight:

| | |
|---|---|
| potassium perchlorate | 88 |
| cellulose triacetate | 10 |
| plasticiser selected from the group consisting of triacetin and tricresyl phosphate | 2.5 |
| acetylene black | 0.2 |
| aluminium powder | 1. |

6. A process according to claim 1 wherein said propellant has the following composition, in parts by weight:

| | | |
|---|---|---|
| potassium perchlorate | in excess of | 80 to 92 |
| silicone resin having a carbon content of less than 33% | | 8.5 to 14 |
| catalyst for said silicone resin | | 0.8 to 1.5 |
| acetylene black | | 0.15 to 0.5 |
| aluminium powder | | 0.5 to 2. |

7. A process according to claim 1, wherein said oxygen-containing inorganic compound used in step (b) has a decomposition temperature of from 225° to 700°C, said compound being in the form of granules or pellets containing a non-oxidisable binder, in an amount between 1 and 7 percent, said binder being selected from the group consisting of aluminum stearate, potassium bromide, plaster and cement.

8. A process according to claim 1, wherein said cooling means used in step (c) consists of a compound which decomposes at a temperature below 200°C to produce a gas.

9. A process according to claim 8, wherein said compound is selected from the group consisting of alkali metal and alkaline earth metal oxalates, carbonates and bicarbonates, and is in the form of pellets.

10. A process according to claim 1, wherein said cooling means used in step (c) comprises a heat exchanger.

11. An apparatus adapted to inflate a safety device in a moving vehicle, comprising a combustion chamber, a solid pyrotechnic composition located in said combustion chamber, said composition consisting of a composite solid propellant having a high content of inorganic non-nitrogenous oxidant in excess of 80 percent, and a low content of a carbonaceous, oxygen-containing binder not exceeding 17 percent, the remaining ingredient being free of nitrogenous compounds, said composition producing hot gaseous products on ignition, ignition means in said combustion chamber, means for discharging the gaseous products from the combustion chamber into a first cooling chamber, an oxygen-containing inorganic compound of low thermal stability in said first cooling chamber capable of liberating only oxygen from under the action of heat from said gaseous products, a second cooling chamber arranged to receive said gaseous products from the first cooling chamber and cooling means in said second cooling chamber.

* * * * *